United States Patent [19]

Anderson et al.

[11] Patent Number: 4,592,485

[45] Date of Patent: Jun. 3, 1986

[54] MEAL VENDING APPARATUS

[75] Inventors: C. Keith Anderson, Tempe; George C. Vieth, Jr., Avondale; Lane D. Vance, Mesa; Darwin D. Grant, Scottsdale, all of Ariz.

[73] Assignee: Meals Incorporated, Phoenix, Ariz.

[21] Appl. No.: 611,512

[22] Filed: May 17, 1984

[51] Int. Cl.[4] ..... G07F 11/72

[52] U.S. Cl. ..... 221/150 HC; 221/232; 165/61; 414/117; 414/118; 219/10.55 R; 99/357; 99/359

[58] Field of Search ..... 99/357, 359; 219/10.55 R; 414/117, 118; 165/61, 65; 221/150 HC, 150 A, 232, 227, 228, 229, 268, 269, 292

[56] References Cited

U.S. PATENT DOCUMENTS

| | | | |
|---|---|---|---|
| 3,055,547 | 9/1982 | Radcliffe et al. | 221/232 |
| 3,340,790 | 9/1967 | Simjian | 221/150 HC |
| 3,397,817 | 8/1968 | Smith | 221/150 HC |
| 3,768,807 | 10/1973 | Spengler | 414/77 |
| 4,398,651 | 8/1983 | Kumpfer | 219/10.55 R |

*Primary Examiner*—H. Grant Skaggs
*Attorney, Agent, or Firm*—H. Gordon Shields

[57] ABSTRACT

Dispenser apparatus for a complete meal includes a refrigerated cabinet in which is disposed a plurality of prepared meal packages which include hot portions and cold portions, the cold portions being protected by foil wrap or other microwave impregnable shield. After a meal has been paid for, the meal package is transferred from the top of a stack and moved to a microwave oven where the hot portion of the meal is warmed by microwave energy. The portion or portions of the meal which are shielded from the microwave energy remain cool so that the meal package, as delivered, includes warm portions and cool portions.

20 Claims, 16 Drawing Figures

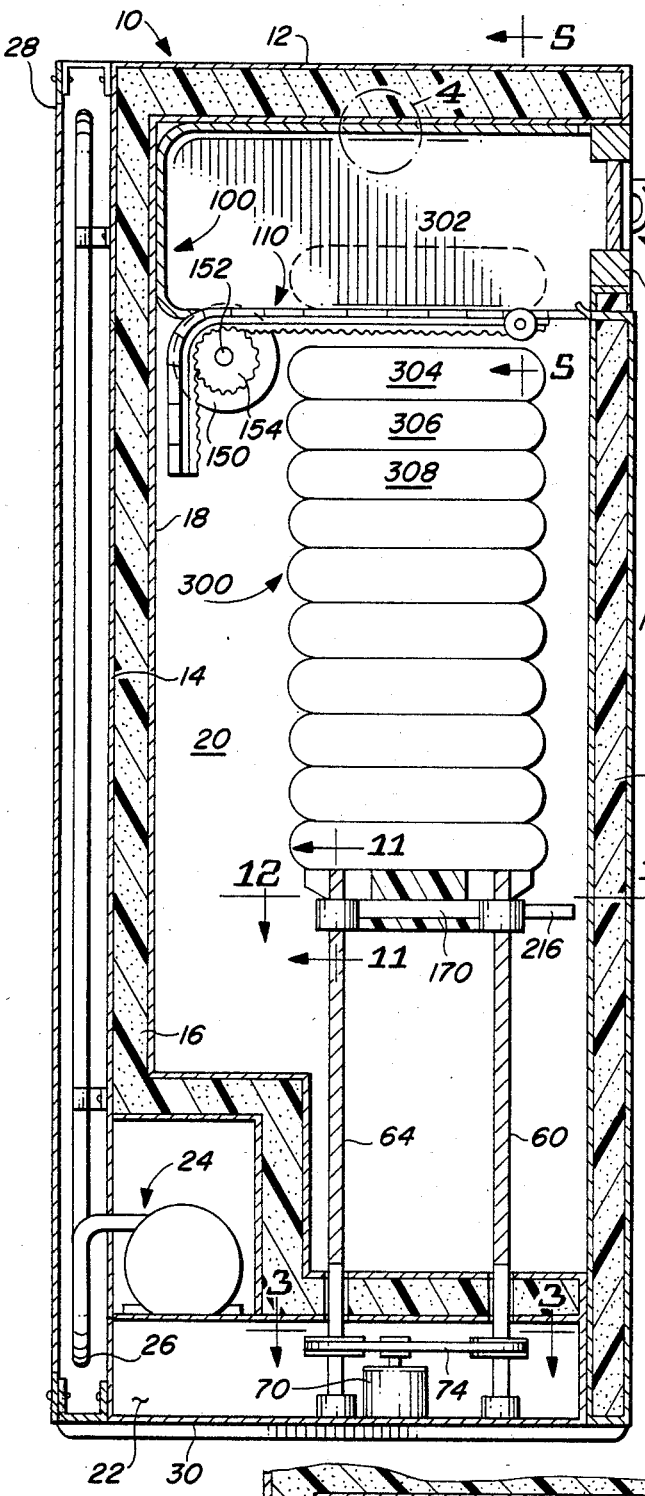
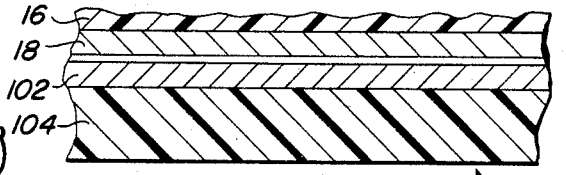
FIG. 4
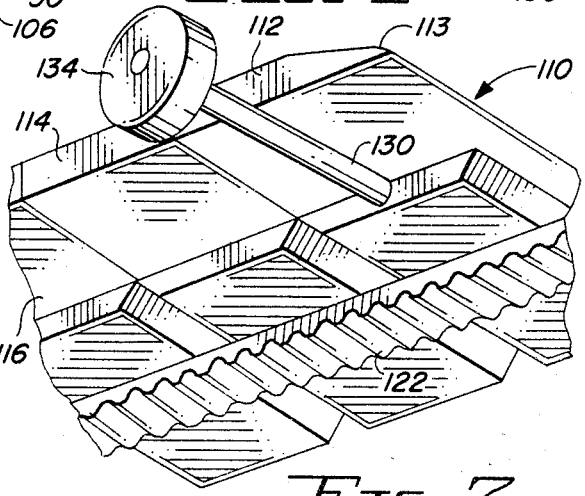
FIG. 7
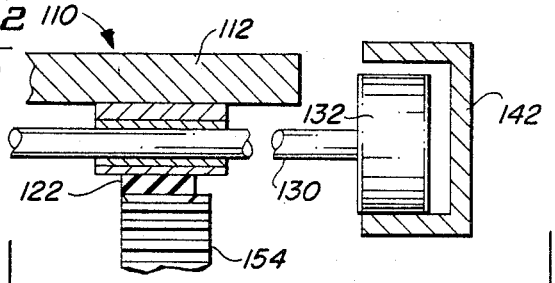
FIG. 6
FIG. 2
FIG. 5
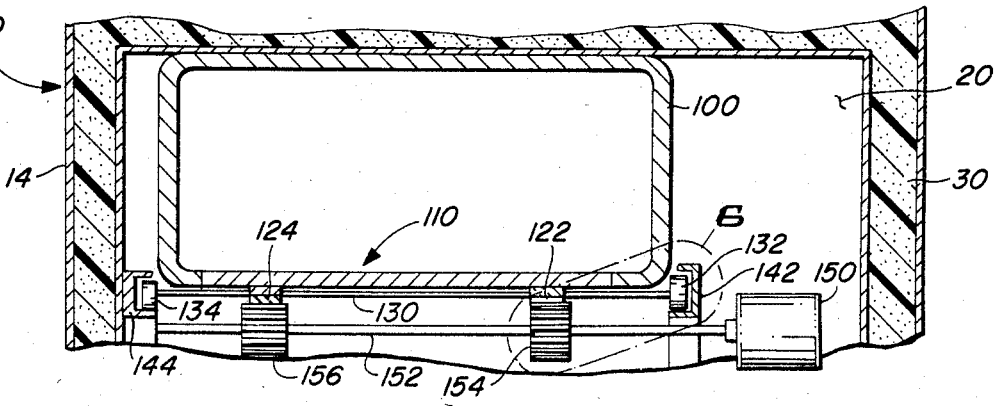

MEAL VENDING APPARATUS

BACKGROUND OF THE INVENTION

1. Field of the Invention:

This invention relates to food dispensing apparatus and, more particularly, to apparatus which warms and dispenses a complete meal from within a refrigerated housing.

2. Description of the Prior Art:

There are several different types of food dispensing apparatus from which a user may select a particular food item, such as an individual element or a complete meal. Most of the apparatus include a plurality of separate compartments, each of which compartments has its own door so that a single element may be paid for and may be selected. Each individual item is accordingly selected and paid for. Obviously, such apparatus is cumbersome and complicated in that a plurality of compartments must be serviced. Moreover, the apparatus is costly due to the many doors and compartments involved.

There are also other types of food dispensing apparatus, such as cabinets in which there is a single dispenser opening from which any of a plurality of elements may be dispensed. Within the apparatus, which is some type of cabinet or housing, there is a plurality of vertically oriented racks. Each vertical rack includes different compartments for holding the same element. When a coin is inserted to pay for an element, a button is pushed or a handle is pulled to select the vertical stack from which an item is to be dispensed. The action of pushing a selector switch or pulling a handle, or the like, simply causes the bottommost element from a particular stack to be actuated to release the element which falls through a chute to the dispensing opening. The user then removes the selected item from the opening.

There are, of course, many other different types of apparatus, but all are generally similar. A coin or bill is used to pay for an item, the item is selected, and the item is removed from either a compartment or from the bottom of a chute or the like. Such types of dispensing apparatus have been in use for many years.

With the advent of such things as microwave ovens, it has become possible to have complete meals served from a refrigerated cabinet by having the selected meal warmed in a microwave oven. An example of apparatus for accomplishing this is shown in U.S. Pat. No. 4,398,651. The '651 apparatus has some inherent problems, such as the loading and dispensing system. The entire front of the cabinet or housing must be removed in order to load meals into the cabinet. In addition, the microwave oven must also be removed in order to load meals into the cabinet. The meal packages are handled by relatively complicated handling systems, including movable racks, chutes, etc.

The apparatus of the present invention overcomes the problems of the apparatus of the '651 patent and the other prior art by simplifying the loading of the meals into the housing and by simplifying the loading of a meal package into and out of a microwave oven.

SUMMARY OF THE INVENTION

The invention described and claimed herein comprises a food dispensing apparatus in which complete meals are heated and dispensed. The apparatus includes a microwave oven integral within a cabinet in which the meal packages are heated and from which the packages are dispensed. The meal packages include portions, such as salads and desserts, which are shielded from microwave radiation to prevent their being heated while the rest of the food in the package is being heated. The microwave oven is disposed above the meal packages, and the packages are loaded into the oven through a movable bottom.

Among the objects of the present invention are the following:

To provide new and useful meal dispensing apparatus;

To provide new and useful meal dispensing apparatus from which meals having hot and cold portions may be dispensed;

To provide new and useful food dispensing apparatus in which a meal package is moved to a microwave oven, and portions of the selection are then heated prior to dispensing;

To provide new and useful food dispensing apparatus in which a microwave oven warms only predetermined portions of a selected meal;

To provide new and useful food dispensing apparatus having an integral materials handling system including apparatus for moving meal packages vertically; and To provide new and useful food dispensing apparatus in which food packages are self aligning in a vertical stack.

BRIEF DESCRIPTION OF THE DRAWING

FIG. 2 is a view in partial section of the apparatus of FIG. 1, taken generally along line 2—2 of FIG. 1.

FIG. 4 is an enlarged view in partial section of a portion of the apparatus of the present invention taken generally from circle 4 of FIG. 2.

FIG. 5 is a view in partial section of a portion of the apparatus of the present invention taken generally along line 5—5 of FIG. 2.

FIG. 6 is an enlarged view of a portion of the apparatus of FIG. 5, taken generally along the oval 6 of FIG. 5.

FIG. 7 is a bottom perspective view of a portion of the apparatus of the present invention.

DESCRIPTION OF THE PREFERRED EMBODIMENT

Figure 1:
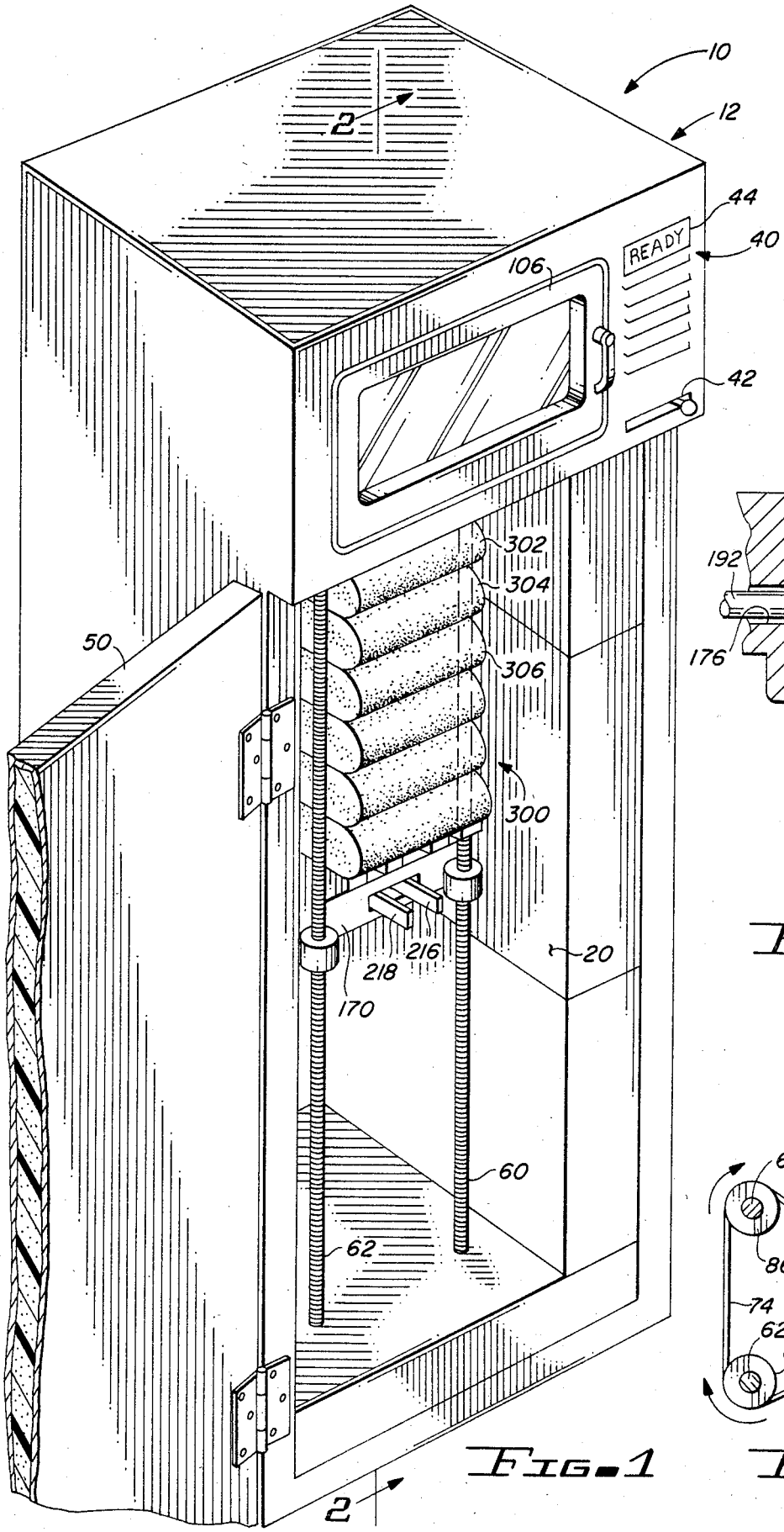
FIG. 1 is a perspective view of the apparatus of the present invention.

FIG. 1 is a perspective view of meal vending apparatus 10 of the present invention. FIG. 2 is a side view in partial section of the apparatus 10 taken generally along line 2—2 of FIG. 1. For the following discussion, reference will be made primarily to FIGS. 1 and 2.

The meal vending apparatus 10 includes a housing 12 which is generally a shell-type structure. The shell-type structure includes an outer shell 14 and an inner shell 18 with appropriate insulation 16 disposed between the inner and outer shells. It will be understood that the shells, both inner and outer, are made of a plurality of panels which define top, back, bottom, and side panels of the apparatus. Moreover, as is best shown in FIG. 2, there is also a lower bottom panel 30 which is secured to the inner and outer shells at the front, sides, and generally at the back. However, the bottom portion of the inner and outer shells, and the insulation layer, is disposed above the bottom panel or plate 30.

Within the housing 12, and generally defined as being within the insulated portion of the cabinet or housing is a refrigerated compartment 20. Below the insulated, refrigerated compartment 20, and above the bottom panel 30 is an accessory compartment 22. Disposed within the accessory compartment 22 is a refrigeration unit 24, which is shown only schematically in FIG. 2. Included as part of the refrigeration unit 24 are condenser coil 26. The condenser coils 26 are disposed outside of the rear portion of the outer shell 14.

A rear mesh or screen 28 is secured to the back portion of the cabinet 12 and rearwardly or outwardly from the outer shell 14. The condenser coils 26 are shown in FIG. 2 as disposed between the rearportion of the outer shell 14 and the mesh or screen 28. The mesh or screen 28 is used for heat transfer purpose, to allow air to circulate to cool the condenser coils. However, as is well known and understood, the condenser coils 26 could be appropriately disposed in heat transfer relationship directly with the mesh or screen 28.

A rear mesh or screen 28 is secured to the back portion of the cabinet 12 and rearwardly or outwardly from the outer shell 14. The condenser coils 26 are shown in FIG. 2 as disposed between the rear portion of the outer shell 14 and the mesh or screen 28. The mesh or screen 28 is used for heat transfer purposes, to allow air to circulate to cool the condenser coils. However, as is well known and understood, the condenser coils 26 could be appropriately disposed in heat transfer relationship directly with the mesh or screen 28.

In the upper portion of the refrigerated compartment 20 is a microwave and control section 40. Disposed within the microwave and control section 40 is a microwave oven 100. Disposed adjacent to the microwave oven 100, as may best be understood from reference to FIG. 1, are the appropriate electronic controls, timing elements, and other control units or elements required for the operation of the meal dispenser apparatus 10. Shown in FIG. 1 is a money receptacle unit 42 which may receive the money from a perspective user of the apparatus 10. Money receptacles are well known and understood in the art.

Above the money receptacle 42 is a "ready" panel 44. When a meal package has been heated within the microwave oven 100, and is ready for removal from the microwave oven, the "ready" panel 44 illuminates, notifying or advising the user that the meal package or container is ready to be removed from the oven.

At the front of the refrigerated compartment 20 is a service door 50. The service door 50 is appropriately hingedly connected to the cabinet or housing 12 and comprises a part thereof. The door 50, like the rest of the housing or cabinet 12, includes a layer of insulation disposed between an inner and an outer shell. The door 50 also locks to the front of the cabinet, thus allowing only a service man with an appropriate key to open the door for servicing the meal packages, etc., within the compartment 20.

Secured to the bottom panel or plate 30, and extending upwardly therefrom, are four threaded rods, including a threaded rod 60, a threaded rod 62, a threaded rod 64, and a threaded rod 66. The threaded rods extend upwardly through the bottom portion of the shells and insulation and into and generally through the refrigerated compartment 20. They terminate just below the bottom of the microwave oven 100. The threaded rods 60 are appropriately journaled for rotation on the bottom panel 30.

Figure 3:
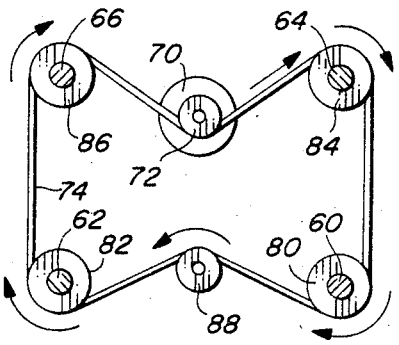
FIG. 3 is a schematic representation of a portion of the apparatus of the present invention taken generally along line 3—3 of FIG. 2.

A reversible motor 70 is disposed adjacent to the four threaded rods and is appropriately secured to the bottom panel 30. The motor 70 causes rotation of the threaded rods 60 . . . 66. The operation of the motor 70 and of the rods 60 . . . 66 is best illustrated in FIG. 3, which comprises a view in partial section taken generally along line 3—3 of FIG. 2. The motor 70, and the bottom of the threaded rods 60 . . . 66 are, as shown in FIG. 2, disposed within the accessory compartment 22.

A pulley 80 is appropriately secured to the lower portion of the threaded rod 60. Similar pulleys 82, 84, and 86 are respectively secured to the lower portions of the rods 62, 64, and 66. A pulley 72 is secured to the output shaft of the motor 70. A belt 74 extends about the pulley 72 and about the pulleys 80 . . . 86. An idler or tension adjusting pulley 88 is also used in conjunction with the pulley 72 and the pulleys 80 . . . 86 and the belt 74.

Rotation of the motor 70, and of its pulley 72, results in movement of the belt 74 about the pulleys 80 . . . 88. The rotation of the pulleys in turn imparts rotation, in the same direction, for the threaded rods 60 . . . 66.

A platform 170 is secured to the rods 60 . . . 66 within the refrigerated compartment 20. A stack of meal packages 400 is disposed on the platform 170. The motor 70 is actuated in response to the insertion of money into the money receptacle 42 to cause the platform 170 to move upwardly, as will be discussed below. The top or uppermost meal package 400 is moved into the microwave oven 100 and is there heated. Heating is accomplished by microwave energy from a magnetron within the microwave oven 100. After the predetermined or preset time period for heating the food package, the magnetron turns off, the ready panel 44 illuminates, and the user then removes the meal package from the microwave oven 100.

The microwave oven 100 includes a front door 106 which is opened by the user to remove the food package.

The construction of a microwave cabinet is well known and understood. FIG. 4 comprises an enlarged view in partial section taken generally from circle 4 of FIG. 2, and illustrating the general cabinet construction of a microwave oven. A portion of the insulation layer 16 is shown in FIG. 4 disposed above a portion of the inner shell 18. The microwave oven 100 is disposed adjacent to the inner shell 18.

The microwave oven 100 includes an outer cabinet shell 102, which is typically made of stainless steel. On the inside of the structural layer 102 is an absorptive layer 104. The purpose of the absorptive layer is, of course, to prevent microwave energy from reflecting from the steel wall 102 and back to the magnetron, thus damaging the magnetron. The construction of a microwave oven, including the cabinet, is well known and understood in the art. As indicated above, in the apparatus of the present invention, the microwave oven 100 is disposed within the insulated cabinet 12 of the food dispensing apparatus 10.

Details of the microwave oven 100 are further illustrated in FIGS. 5, 6, and 7. FIG. 5 is a view in partial section taken generally along line 5—5 of FIG. 2. FIG. 6 is an enlarged view of a portion of the apparatus illustrated in FIG. 5 taken generally from oval 6 of FIG. 5. FIG. 7 is a bottom perspective view of a portion of the microwave oven 100, further illustrating details of the oven shown in FIGS. 2, 5, and 6. For the following discussion, reference will primarily be made to FIGS. 2, 5, 6, and 7.

For loading a meal package into the interior of the microwave oven 100, a segmented bottom or guillotine door 110 is used. The segmented bottom or guillotine door 110 is an integral part of the bottom of the cabinet of the microwave oven 100. The bottom 110 includes a plurality of segments, each of which is secured to an adjacent segment. The bottom 110 is movable on a pair of tracks 142 and 144. The guillotine door 110 is segmented, in a manner similar to garage doors, to enable the door, or portions thereof, to move through an arc of substantially ninety degrees, as will be discussed below.

Several of the segments of the bottom or guillotine door 110 are specifically identified by reference numerals. They include a front or loading segment 112, a second segment 114, and a third segment 116. It will be understood that there are more than just the three specifically identified segments.

The first segment 112 includes a front sloping cam portion 113. The sloping cam portion 113 cooperates with the curvature of the individual meal packages to cam the uppermost meal package from a stack of packages and to lift the package upwardly and into the interior of the microwave oven 100.

Secured to the bottom of the front segment 112 is a pair of belts 122 and 124. The belts 122 and 124 are grooved drive belts which cooperate with a pair of drive wheels or gears 154 and 156 for moving the segmented door 110.

The drive wheels or gears 154 and 156 are secured to an output shaft 152 of a motor 150. The motor 150, and the drive wheels or gears 154 and 156, are disposed at the upper rear portion of the refrigerated compartment 120, and immediately below the rear of the microwave oven 100. This is best shown in FIG. 2. The drive wheels 154 and 156 include cogs or gear teeth which mate with grooves in the drive belts 122 and 124, respectively, for movement of the segmented bottom or guillotine door 110.

The bottom or door 110 is supported in a pair of tracks 142 and 144 by a pair of rollers 132 and 134, respectively. The rollers 132 and 134 are disposed on the outer ends of a rod 130. The rod 130 is in turn secured to and beneath the front or lead segment 112.

While only a single rod 130 and a pair of rollers 132 and 134 are illustrated, it is obvious that additional rods and rollers may be used to support the guillotine door 110, if desired or if necessary. Such additional rod or rods will be similarly secured to the bottom of various segments, as required, with their rollers disposed in the tracks.

The tracks 142 and 144 are appropriately secured within the refrigerated compartment 20. The tracks 122 and 124 are generally straight, substantially parallel to the bottom 110 beneath the microwave wave oven 100. At the rear of the microwave oven 100, and generally in the area of the inner shell 18, the tracks 142 and 144 curve downwardly in an arc of about ninety degrees. The radius of curvature of the tracks 142 and 144, and the length of each of the segments of the bottom 110, are appropriately dimensioned to allow for the moving of the door segments to prevent binding, etc., and to allow for the smooth movement of the door 110 as it moves both rearwardly and forwardly.

The motor 150 is, of course, a reversible motor, to allow for the movement of the bottom or guillotine door 110 in both a rearward, retracted direction and in a forward, loading and closing direction. This will be discussed in more detail below.

The drive wheels or gears 154 and 156, best shown in FIG. 5, are secured to the drive shaft 152. The drive shaft 152 is secured at one end to the output shaft of the motor 150. At the end of the shaft 152 remote from the motor 150 is a bearing or bushing which supports the shaft 152 and in which the shaft is journaled for rotation.

As best shown in FIG. 2, the motor 150, and the drive wheels 154 and 156, are disposed at the rear of the oven 150, where the segments of the door 110 and the tracks 142 and 144 make their ninety degree turns. This allows for maximum length of the belts 122 and 124 to be disposed on the drive wheels 154 and 156, respectively.

The several segments which comprise the bottom 110 are appropriately secured together so that when the door 110 is closed, as shown in FIG. 2, the door or bottom 110 defines a unitary bottom closure for the microwave oven 100, and on which rests a food container or package 302. The container or package 302 is shown in phantom in FIG. 2.

Figure 8:
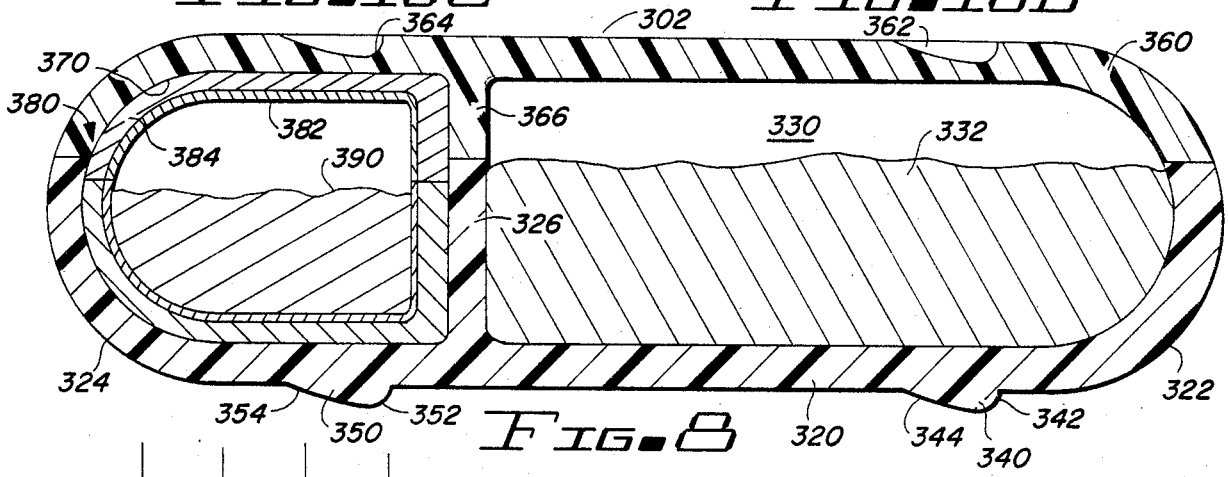
FIG. 8 is an enlarged view in partial section of a part of the food package apparatus of the present invention.
Figure 9:
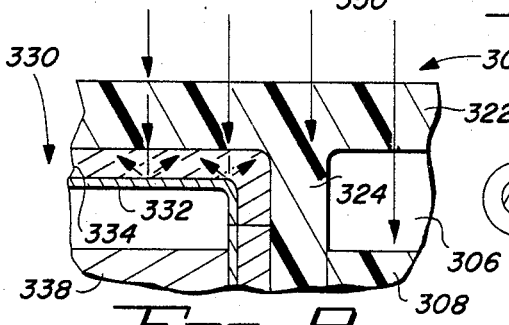
FIG. 9 is an enlarged view illustrating a feature of the food container of FIG. 9.

FIG. 8 is a view in partial section through a meal container 302. The container 302 includes a bottom portion 320 and a top or upper portion 360. The portions 320 and 360 are, of course, mating portions. The top and bottom portions include interior partitions which divide the container 302 into different areas for receiving different food items. The bottom portion 320 includes a convexly curved front portion 322 and a convexly rounded rear portion 324 and an interior partition 326. The partition 326 is aligned with a mating or aligned interior wall or partition 366 of the upper portion 340. On one side of the aligned partitions 326 and 366 is a relatively large compartment or chamber 330 in which food, schematically represented by reference numeral 332, is disposed. The food 332 will be warmed by microwave energy from the magnetron of the microwave oven 100. The chamber or cavity 330 accordingly is a "hot" chamber or compartment.

On the opposite side of the aligned partitions or walls 326 and 366 is a second chamber or compartment 370 in which is disposed a container 380. The container 380 is designed to contain foods, such as salads or desserts, which remain cool and which are not to be heated by the microwave energy. For this purpose, the cold container 380 includes an inner reflective layer 382 surrounded by an outer, absorptive layer 384.

The container 380 is divided into upper and lower portions, and the two portions mate together to define a container which wholly encloses food, denoted by reference numeral 370, which remains cool. The container 380 is shown form-fitting with the compartment 370.

The inner, reflective layer 382 is preferably aluminum foil or the like, which is impervious to microwave energy and which reflects microwave energy, thus preventing microwave energy from the oven 100 from entering into the container 380 and heating the food 390. Microwave energy which is not initially absorbed by the layer 384 is reflected by the inner, foil layer 382 backwardly or outwardly, away from the foil layer 382. The microwave energy reflected from the foil layer 362 again must pass through the absorptive layer 364. Some microwave energy is absorbed by the layer 364 before it contacts the inner, reflective foil layer 362. Then the microwave energy thus reflected again passes through the microwave absorptive layer 364, where most of the energy is finally absorbed. The microwave energy which extends outwardly through the absorptive layer 334 must again pass through the walls of the container 302. What little energy escapes from the container 302, is relatively minor and is not in substantial danger of harming the magnetron of the oven 100.

As is well known and understood, the container 302, including its bottom portion 320 and its top portion 360, is preferably made of material that is transparent to microwave energy, such as styrofoam, or the like. The styrofoam material is also a relatively good insulator, which helps to hold the food 308 and 338 cool while the container 302 is in the refrigerated container portion 20 of the housing or cabinet 12. The material also allows the food 332 to hold its heat after being heated in the oven 100, and at the same time helps to keep the food 390 cool, as is desired.

It is highly desirable that the containers 302, 304, 306, etc., be self-aligning and stackable. It is also desired that the containers or packages 302 . . . in the stack 300 maintain their vertical orientation during the transfer of the uppermost container 302 from the stack 300 into the microwave oven 100. For providing these stacking and orienting characteristics, a plurality of generally teardrop shaped protrusions extends downwardly from the bottom 320, and a plurality of mating, teardrop shaded indentations extends downwardly into the top 360. A pair of such protrusions 340 and 350 are shown extending downwardly from the bottom 320 of the container 302 in FIG. 8. A pair of tear drop shaped concavities 362 and 364 are shown extending downwardly into the top 360 of the container 302. The concavities receive and matingly engage the protrusions of a package disposed above. Or, in other words, the protrusions on the bottom of one package extend into the concavities of another package or container disposed immediately below the one package.

The bottom convex protrusions 340 and 350 are, as indicated, generally of a teardrop configuration, or rather are about half of a teardrop. They each include a relatively steep front nose and a relatively shallow sloping rear surface. The bottom protrusion 340 includes a relatively steep front nose 342 and a relatively gradually sloping rear cam surface 344. The protrusion 350 includes a relatively steep front nose 352 and a relatively shallow sloping rear cam surface 354. The configurations of the concavities 362 and 364 are substantially the same as the outer configurations of the protrusions 310 and 316 so that the protrusions are matingly received into the concavities.

With the protrusions extending downwardly from the bottom surface of the containers, it will be understood how the containers are self aligning. There are preferably about four protrusions extending downwardly from the bottom of the containers, and there are thus the same number, or four, concave receptacles extending downwardly into the top surface of each container. Since the protrusions and mating concavities are not symmetrical, obviously the containers must be oriented in a particular manner. The orientation automatically aligns the containers for being loaded by the cam action of the leading edge 113 of the front segment 112 of the door 110. This is best illustrated in conjunction with FIGS. 10A, 10B, 10C, and 10D, which are sequential views illustrating the loading of a container 300 into the interior of the oven 100. Attention will also be directed to FIGS. 1 and 2, in addition to FIGS. 10A, 10B, 10C, and 10D for the following discussion.

When a user of the apparatus 10 desires to purchase a meal, the money receiving receptacle 42 will be moved outwardly from the microwave oven portion 40 of the housing 12. As the money receptacle is pushed inwardly, with an appropriate bill(s), etc., thereon, the receipt of the money is acknowledged or sensed and appropriate electrical circuitry actuates the loading and heating sequence of the apparatus 10.

The segmented bottom or guillotine door 110 of the microwave oven 100 first retracts. This is accomplished by actuation of the motor 150. As the motor 150 is actuated, the drive shaft 152 rotates and the drive wheels 154 and 156, which mesh with the belt or track portions 122 and 124, cause the door 110 to move rearwardly and downwardly. The segments 112 . . . of the door 110 move rearwardly and downwardly as their rollers move in the tracks in response to the motor 150. As discussed above, the door 110, and the segments thereof, are guided by the tracks 142 and 144 in which ride the rollers 132 and 134, respectively, as shown in FIGS. 4 and 5, and any other required rollers.

When the guillotine door 110 is in its rearmost position, or retracted, with some segments extending downwardly, substantially parallel to the back or rear portion of the housing 12, and the front segments, including the leading segment 112, disposed rearwardly of the stack 300 of meal packages or containers, the motor 70 actuates to rotate the threaded rods 60, 62, 64, and 66 to cause the platform 170 to move upwardly. It will be understood that the rearward and forward motions of the door 110 may be controlled by microswitches, photosensors, or any other appropriate control elements. Similarly, the upward movement of the platform 170 may also be controlled by similar, appropriate control elements.

Figure 10A:
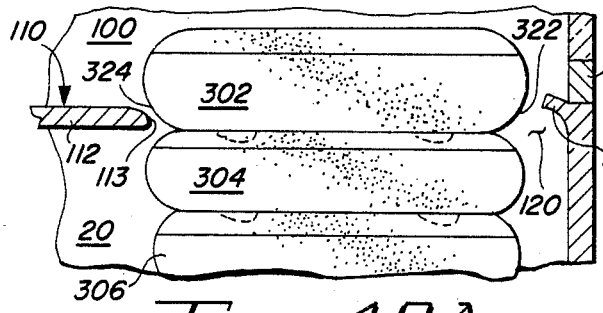
FIGS. 10A, 10B, 10C, and 10D are sequential views, in partial section, illustrating part of the functioning of the apparatus of the present invention.

In FIG. 10A, the guillotine door 110 is shown in its rearmost or retracted position, with the frontmost segment 112 disposed rearwardly of the stack 300 of meal packages. When the segment 112 reaches the position shown, the motor 70 actuates to raise the platform 170, and the stacked meal containers or packages 302, 304, etc., thereon, upwardly. The motor 70 stops the upward movement of the platform 170 and the meal packages when the uppermost or topmost container 302 is almost completely disposed within the oven 100.

In FIGS. 10A, 10B, 10C, and 10D, there are three meal containers or packages illustrated, including the container 302, the container 304, and the container 306. The top or uppermost container or package is the container or package 402. When the motor 70 stops the upward movement of the platform 170, and the stack 300 of meal packages, the uppermost package 402 is substantially within the microwave oven 100, but not completely. The top of the second package 304 is disposed beneath the bottom of the door 110 so that movement of the door will clear the top of the container 304.

In order for the door 110 to close, the package 302 must be moved upwardly and thus fully within the oven 100. This is accomplished by the combination of the curvature of the container 402 and the sloping leading edge 113 of the front segment 112.

Figure 10B:
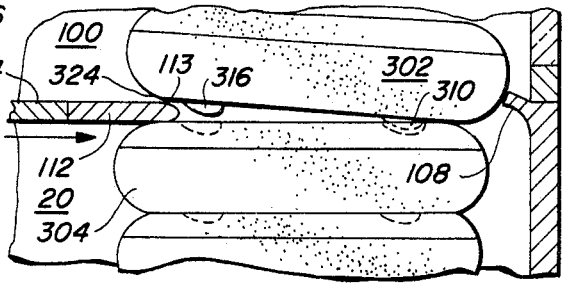
Figure 10C:
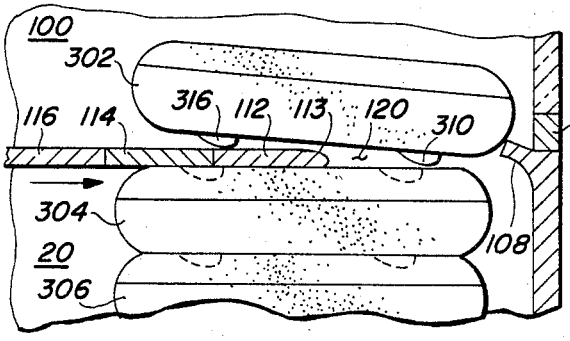

After the motor 70 stops the upward movement of the platform 170 and the stack 300 of meal packages, the motor 150 then starts to run, but reversed from its previous direction, causing the door 110 to move forwardly. As the door 110 moves in the forward direction, the sloping leading edge 113 of the front or leading segment 112 of the door 110 contacts the curved rear portion 324 of the uppermost container 302. This is shown in FIG. 10B. The continued forward movement of the door 110 causes, by cam action, the package 402 to move upwardly and to tip slightly. The rear portion of the food or meal container 402 is then disposed on the top surface of the door 110. This is shown in FIGS. 10B and 10C.

As discussed above, and primarily in conjunction with FIG. 8, the sloping teardrop configuration of the convex, teardrop shaped protrusions on the bottom of the food containers also defines a cam surface for continuing the upward camming movement of the food packages. Thus, the relatively gentle rear slope 354 of the protrusion 350 contacts the sloping edge 113 of the segment 112 to continue the upward camming of the container 302. At the same time, the relatively sharply curved front portions of the protrusions help to prevent the container 402 from slipping forwardly, thus allowing the door 110 to continue its forward movement beneath the food package 302.

The continued upward movement of the container 402 will, ultimately, result in both protrusions 340 and 350 moving out of their mating receptacles in the top of the container 304 in the stack 300, and the uppermost container 302 will accordingly move forwardly. There is a stop element 108 built into the microwave oven 100 which acts as a combination of a forward stop and an upward cam in that the rear surface of the stop 108 slopes upwardly and combines with the curved front portion 322 of the container 302 to help cam the package 302 upwardly. This is shown sequentially in FIGS. 10B and 10C. The sloping rear portion 344 of the front protrusion 340 of the package 302 acts as a cam surface for the leading edge 113 of the door segment 112 to complete the upward biasing motion of the package 302 as the door 110 continues its forward movement.

Figure 10D:
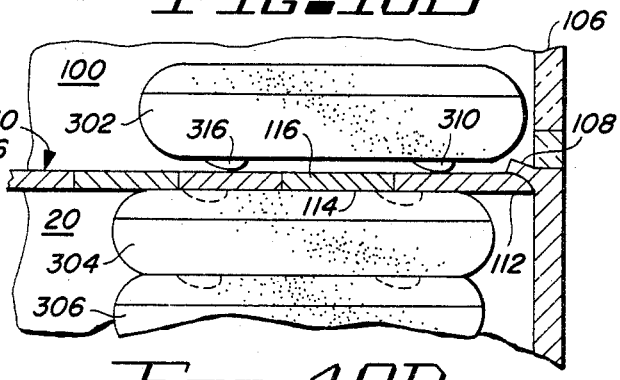

As shown in FIG. 10D, the sloping surface 113 of the front segment 112 of the door 106 nests against the bottom surface of the stop 108 when the door 110 is in its most forward or closed position. At this point, the door 110 stops and the container 302 is disposed on the top surface of the door 106 and is disposed entirely within the microwave oven 100.

When the door 110 completes its inward travel, the motor 150 stops, and the magnetron of the oven 100 turns on for a predetermined period of time to warm the food disposed within the container 302. With different meals capable of being dispensed from the apparatus 10, different heating times may be required, and accordingly the oven 100 may be appropriately programmed by a service man to provide an appropriate predetermined period of time during which the magnetron is "on" for heating purposes. Such controls are well known and understood, and accordingly are not illustrated herein.

When the magnetron turns off, signaling the completion of the warming period, the "ready" panel 44 on the front of the microwave housing portion 40 illuminates, signaling that the meal package 302 is now ready to be removed from the oven. At such time as the magnetron turns off, and the "ready" sign turns on, the door 106 may be opened, and the package 302 and its now warmed meal may be removed from the oven 100. As previously indicated, certain portions of the meal within the container 302 are shielded from the microwave energy, such as a salad and a dessert, and those portions remain cool, as refrigerated, while the other portions of the meal are warmed by the microwave energy. The warmed or hot meal may then be removed from the oven and may be eaten by the user.

For servicing the apparatus 10, the front service door 50 opens to provide access to the interior of the refrigerated compartment 20. Additional meal packages or containers may be added to the stack remaining within the refrigerated chamber 20, or some or all of the meal packages may be removed, as desired.

In order for new meal packages to be added, the platform 170 must be returned to its lowest or most downward position. This may be accomplished in either one of two ways. As originally stated, the motor 70 of FIGS. 2 and 3 is a reversible motor. By an appropriate switch, not shown, on the interior of the chamber 20, the motor 70 may be reversed to cause the threaded rods 60 . . . 66 to rotate in the opposite direction from that direction which is used to cause the platform 170 to move upwardly. With the reversal in the direction of the motor 70 and of the threaded rods 60 . . . 66, the platform 170 will move downwardly. Again, appropriate microswitches, or other appropriate control elements, may be used to stop the motor 70 when the platform 170 is in its most downwardly position.

Figure 11:
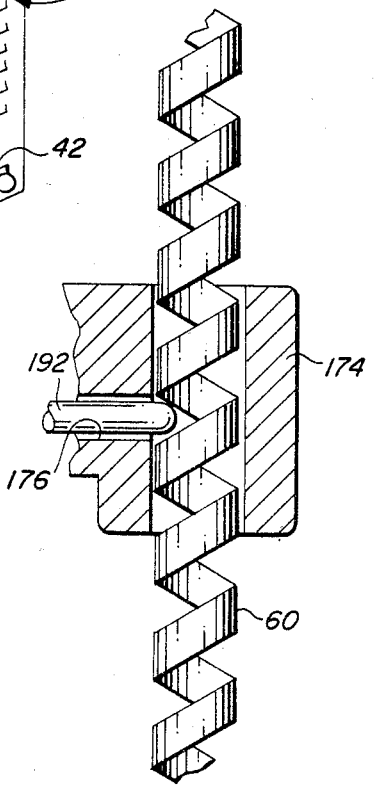
FIG. 11 is an enlarged view in partial section taken generally along line 11—11 of FIG. 2.
Figure 12:
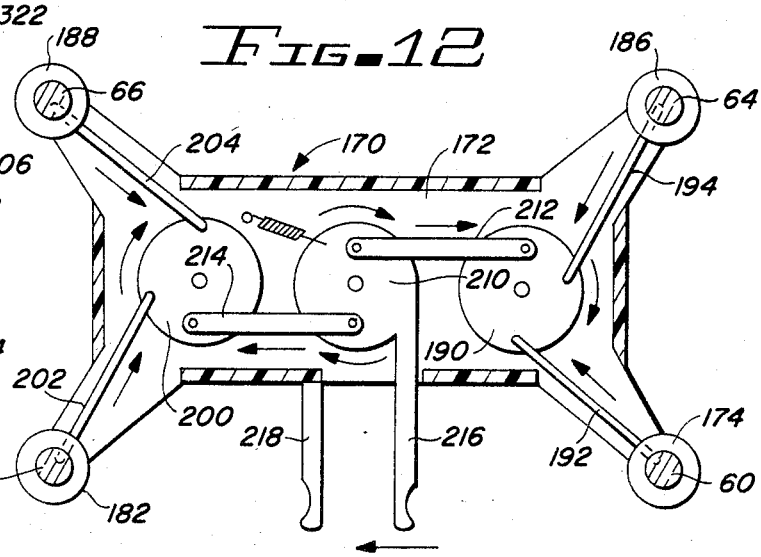
FIG. 12 is a view in partial section taken generally along line 12—12 of FIG. 2.
Figure 13:
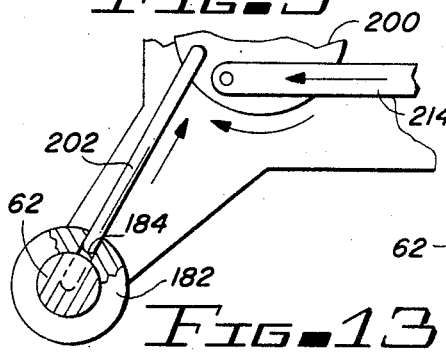
FIG. 13 is a fragmentary view of a portion of the apparatus illustrated in FIG. 12.

In the alternative to reversing the motor 70, a quick release mechanism or system may be utilized by which the platform 170 may be quickly lowered by a service man. The lowering of the platform 170 is best illustrated in FIGS. 11, 12, and 13. However, reference will also be made to FIGS. 1 and 2. FIG. 11 is a view in partial section of a portion of the rod 60 and the platform 170, taken generally along line 11—11 of FIG. 2. FIG. 12 is a top view in partial section of a portion of the platform 170 taken generally along line 12—12 of FIG. 2. FIG. 13 is a fragmentary view, in partial section, of a portion of the platform 170 of FIG. 12, illustrating the sequential operation of the quick release mechanism.

The platform 170 includes a base 172. The base 172 includes four outwardly extending arms. At the outer ends of the four arms are bushings which receive the threaded rods 60 . . . 66. A bushing 174 receives the rod 60, a bushing 182 receives the rod 62, a bushing 186 receives the rod 64, and a bushing 188 receives the rod 66. Each of the four bushings includes a horizontally extending bore through which extends a control rod.

Secured to the top of the base 172, and appropriately journaled thereon for rotation, are three discs, including an actuating disc 190, an actuating disc 200, and a control disc 210. Two control rods are secured to the disc 190 and two control rods are secured to the disc 200. The disc 190 includes a control rod 192 which extends through a bore 176 in the bushing 174, as best shown in FIG. 11. Also secured to the disc 190 is a control rod 194 which extends through a bore in the bushing 186.

The disc 200 includes a rod 202 which extends through a bore 184 in the bushing 182, and a rod 204 which extends through a bore in the bushing 188. The rods 192 and 194 are appropriately secured to the disc 190 for pivoting motion. Similarly, the rods 202 and 204 are appropriately secured to the disc 200 for pivoting motion.

The discs 190 and 200 are secured to the control disc 210 by a pair of connecting rods or links. A connecting rod or link 212 extends between the control disc 210 and the disc 190. A connecting rod or link 214 extends between the control disc 210 and the disc 200.

A handle 216 extends outwardly from the platform 170, as shown in FIGS. 1, 2, and 12. The handle 216 is secured to the control disc 210 at its outer periphery. A fixed handle 218 also extends outwardly from the platform 170. The fixed handle 218 is merely a convenience to aid in moving the handle 216. Movement of the handle 216 causes nation or pivoting of the control disc 210 and, through the links 212 and 214, a corresponding rotation or pivoting of the discs 190 and 200.

The threaded rods 60, 62, 64, and 66 may be tape wound screws, as depicted in FIG. 11, or they may be solid rods with appropriate screw threads on the outer peripheries of the rods. For convenience, a tape wound screw 60 is shown in FIG. 11, with the outer or distal end of the rod 192 extending through the bore 176 of the bushing 174 and into the threads of the screw 60. With the control rod 192 engaged in the threads of the screw 60, and the other control rods 202, 194, and 204 similarly engaged in the screws 62, 64, and 66, respectively, movement of the screws will result in the vertical upwardly or downwardly movement of the bushings and the platform 170 secured to the bushings. The meal packages or containers disposed on the top of the platform 170 will move with the platform.

For obvious reasons, it is desired to have the threaded rods move upwardly relatively slowly so that the movement of the platform 170 and of the meal packages is carefully controlled. On the other hand, for lowering the platform, as by a service man for servicing the apparatus 10, it may be highly desirable to have the platform 170 move downwardly much more rapidly than it moves upwardly. Accordingly, using the motor 70 to move the platform 170 downwardly may not move the platform fast enough, even if the motor 70 is a two-speed motor. It may be an advantage to have a quick release system for the platform 170 which is operable by a service man. With the quick release system illustrated, once the door 250 is opened, the service man simply grasps the handles 216 and 218 and moves the handle 216 toward the fixed handle 218.

When the handle 216 moves toward the handle 218, the control disc 210 rotates clockwise, as illustrated in FIG. 12 by the arrows shown therein. The connecting link or rod 212 is secured to the top or upper portions of both the control disc 210 and the pivoting disc 190. The connecting link or rod 214 is secured to the bottom or lower portions of the control disc 210 and the disc 200. Movement of the control disc 210 in a clockwise direction results in a corresponding clockwise movement of both the disc 190 and the disc 200.

The rods 192 and 194 are secured to the disc 190 in such a manner that clockwise rotation of the disc 190 causes both rods 192 and 194 to be withdrawn from engagement with the threads of the respective screws 60 and 64. Thus, referring to FIG. 11, a relatively slight movement of the rod 192 within the bore 176 will cause the rod 192 to be disengaged or withdrawn from the threads of the screw 60.

The rods 202 and 204 are similarly secured to the disc 200 so that the clockwise rotation of the disc 200 causes the rods 202 and 204 to be withdrawn from the threads of their respective screws 62 and 64. Since the rods 192 . . . 204 are the only connection between the screws 60 . . . 66 and the platform 170, when the rods 192 . . . 204 are withdrawn from engagement with their respective screws, the platform 170 will move downwardly simply by gravitational force. The service man holding the handles 216 and 218 must accordingly control the downward movement or descent of the platform 170 when the rods are withdrawn from the screws.

When the platform 170 is in its full down position, or any position desired by the service man, the handle 216 is released or is moved outwardly, away from the fixed handle 218, the control disc 210, and the discs 190 and 200 secured thereto, pivot or rotate in a counterclockwise direction. The counterclockwise rotation causes an outward movement of the rods 192 . . . 204 within the bores of their respective bushings 174, 182, 186, and 188. The outer tips of the rods 192 . . . 204 then engage the threads of the screws 60 . . . 66, respectively. With the rods once again engaging the threads of the screws, movement of the platform 170 ceases.

For urging movement of the control disc 210 in a counterclockwise direction, there is shown a tension spring 220 extending between the upper and outer portion of the control disc 210 and a fixed pin on the base 172. Movement of the handle 216, in the direction of the arrow shown adjacent to the handle 216, causes clockwise rotation of the discs 210, 190, and 200, and thus the withdrawal of the control rods from their screws is opposed by the tension spring 220. The tension spring 220 urges engagement between the control rods and their respective screws by providing a counterclockwise bias to the control disc 210 and, through the connecting links or rods 212 and 214, to the discs 190 and 200.

In FIG. 13, the clockwise pivoting of the disc 200, caused by movement of the connecting rod 214, from a clockwise rotation of the control disc 210, causes movement of the rod 202 out of engagement with the threads of the screw 62. The rod 202 moves in a bore 184 of the bushing 182. Movement of the handle 218 in the opposite direction from that shown by the arrow thereon in FIG. 12 causes the control disc 210 to move counterclockwise. This counterclockwise movement results in a counterclockwise rotation of the disc 200. This rotation or movement in turn causes the rod 202 to move inwardly through the bore 184 and thus to once again engage the threads of the screw 62.

It will be understood that a service man, by moving the handle 216 toward the handle 218, and thus rotating the control disc 210 and the disc 90 and 200 to withdraw the control rods from engagement with the screws, can move the platform both upwardly and downwardly, as desired. When the rods are disengaged from the screws, the platform 170 may be moved upwardly by manually lifting the platform.

Electrical control and sensor circuits involved in the apparatus of the present invention are well known and understood in the art and accordingly are not shown herein.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for heating and dispensing meal packages, comprising, in combination:
- housing means;
- refrigerated compartment means within the housing means;
- platform means disposed within the refrigerated compartment means and movable upwardly and downwardly;
- oven means disposed within the housing means for receiving a meal package and for heating and dispensing the meal package, including
  - an oven,
  - a bottom door in the oven movable in a first direction to an open position and defining an opening through which the meal package moves into the oven and movable in a second direction to close the opening and to define a bottom for the oven, and
  - a front door through which the meal package is dispensed from the oven after the meal package is heated;
- meal package means disposed in the platform means, including
  - a meal package having a bottom portion and a top portion, and
  - a first cam portion for contacting the bottom door to cam the meal package upwardly into the oven; and
- means for moving the platform means upwardly to move the meal package into the oven.

2. The apparatus of claim 1 in which the bottom door of the oven means includes a sloping surface comprising a second cam portion for camming the meal package upwardly into the oven as the bottom door moves in the second direction.

3. The apparatus of claim 2 in which the meal package includes a first protrusion on the bottom portion having a first sloping rear cam surface comprising a third cam portion for contacting the bottom door to cam the meal package upwardly into the oven, and a first front nose to resist forward movement as the meal package is cammed upwardly.

4. The apparatus of claim 3 in which the meal package means includes a plurality of meal packages disposed on each other to define a stack of meal packages, and each meal package includes the first protrusion, and the top portion of each package includes a first concavity, and the first protrusion of one meal package extends into the first concavity of another, lower, meal package in the stack of meal packages for aligning the meal packages.

5. The apparatus of claim 4 in which each meal package further includes a second protrusion spaced apart from the first protrusion and a second concavity spaced apart from the first concavity, and the second protrusion of one meal package extends into the second concavity of another, lower, meal package in the stack of meal packages.

6. The apparatus of claim 5 in which the second protrusions each include a second front nose to resist forward movement as the meal package is cammed upwardly by the bottom door.

7. The apparatus of claim 6 in which the second protrusions each also include a second sloping rear cam surface comprising a fourth cam portion to cam the meal package upwardly into the oven when contacted by the bottom door.

8. The apparatus of claim 1 in which the bottom door of the oven means includes a plurality of segments, including a lead segment, for allowing the bottom door to curve as it moves in the first and second directions.

9. The apparatus of claim 8 in which the bottom door further includes a sloping cam surface on the lead segment and defining a second cam portion for contracting the first cam portions of the meal package to cam the meal package upwardly into the oven.

10. The apparatus of claim 9 in which the meal package means further includes a fifth cam portion for contacting the oven means to cam the meal package upwardly into the oven.

11. The apparatus of claim 10 in which the oven means further includes a stop element for contacting the meal package to prevent movement of the meal package in a forward direction as the meal package is cammed upwardly into the oven.

12. The apparatus of claim 11 in which the oven means further includes a sixth cam portion for contacting the fifth cam portion of the meal package to cam the meal package upwardly into the oven.

13. The apparatus of claim 1 in which the means for moving the platform means upwardly includes rotatable screw means operatively connected to the platform means and motor means for rotating the rotatable screw means for moving the platform means upwardly.

14. The apparatus of claim 13 in which the platform means includes a platform operatively connected to the rotatable screw means, and the meal package is disposed on the platform.

15. The apparatus of claim 14 in which the platform means further includes quick release means for disconnecting the platform from the rotatable screw means for lowering the platform.

16. The apparatus of claim 13 in which the motor means comprises a reversible motor for rotating the rotatable screw means in one direction to raise the platform means and for rotating the rotatable screw means in another direction to lower the platform means.

17. Apparatus for heating and dispensing a meal package, comprising, in combination:
- refrigerator compartment means for refrigerating the meal package;
- platform means movably disposed within the refrigerated compartment means, including a platform adapted to support the meal package;
- oven means for receiving the meal package and for heating and dispensing the meal package; and
- door means secured to the oven means and movable in a first direction to a first position to open the oven means to receive the meal package and movable in a second direction to a closed position to upwardly move the meal package into the oven means and to close the oven means.

18. The apparatus of claim 17 in which the oven means includes an oven having an open bottom adapted to receive the door means, and a front door through which the heated meal package is dispensed.

19. The apparatus of claim 18 in which the door means includes a cam surface adapted to contact the meal package when the door means moves in the second direction to cam the meal package into the oven.

20. The apparatus of claim 19 in which the oven means is disposed within the refrigerated compartment means.

* * * * *